US008994768B2

(12) United States Patent
Kondo

(10) Patent No.: US 8,994,768 B2
(45) Date of Patent: Mar. 31, 2015

(54) OPTICAL SCANNING APPARATUS AND IMAGE FORMING APPARATUS INCLUDING OPTICAL SCANNING APPARATUS

(75) Inventor: Shunsaku Kondo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 12/973,752

(22) Filed: Dec. 20, 2010

(65) Prior Publication Data

US 2011/0150510 A1 Jun. 23, 2011

(30) Foreign Application Priority Data

Dec. 22, 2009 (JP) ..... 2009-290100
Oct. 27, 2010 (JP) ..... 2010-241202

(51) Int. Cl.

| | |
|---|---|
| ***B41J 2/385*** | (2006.01) |
| ***B41J 2/47*** | (2006.01) |
| ***B41J 2/435*** | (2006.01) |
| ***G03G 13/04*** | (2006.01) |
| ***G03G 15/32*** | (2006.01) |
| ***G03G 15/043*** | (2006.01) |

(52) U.S. Cl.

CPC ..... *G03G 15/326* (2013.01); *G03G 15/043* (2013.01); *G03G 15/0435* (2013.01)

USPC ..... 347/235; 347/129; 347/236; 347/246; 347/250

(58) Field of Classification Search

USPC ..... 347/224, 225, 233, 235, 236, 250

See application file for complete search history.

(56) References Cited

U.S. PATENT DOCUMENTS

| | | | | |
|---|---|---|---|---|
| 6,011,250 | A * | 1/2000 | Minakuchi et al. | 250/205 |
| 2005/0024480 | A1 * | 2/2005 | Yamazaki | 347/243 |
| 2005/0206718 | A1 * | 9/2005 | Komiya et al. | 347/246 |
| 2007/0064088 | A1 * | 3/2007 | Izumiya | 347/261 |
| 2007/0242128 | A1 * | 10/2007 | Sobue | 347/253 |

FOREIGN PATENT DOCUMENTS

| | | | |
|---|---|---|---|
| JP | 05-208522 | A | 8/1993 |
| JP | 2004106419 | A | 4/2004 |
| JP | 2005010495 | A | 1/2005 |
| JP | 2007-236031 | A | 9/2007 |
| JP | 2007-283512 | A | 11/2007 |
| JP | 2008067449 | A | 3/2008 |
| JP | 2009018484 | A | 1/2009 |
| JP | 2009-069639 | A | 4/2009 |
| JP | 2009-294367 | A | 12/2009 |

* cited by examiner

*Primary Examiner* — Justin Seo
*Assistant Examiner* — Kendrick Liu
(74) *Attorney, Agent, or Firm* — Canon USA Inc. IP Division

(57) ABSTRACT

In an optical scanning apparatus, a light source includes a plurality of light emitting elements. A light beam output from the source is scanned and deflected by a polygon mirror so as to form an electrostatic latent image on a surface of a light sensitive member. A control unit controls the source so that the source outputs the light beam in a first period before a second period in which the light beam deflected by the mirror forms the image. During the first period for outputting the light beam from the source a period for scanning a non-image region of the member in a state in which the rotation speed of the mirror is being accelerated or decelerated is made longer than a period for scanning the non-image region of the member in a state in which the rotation speed of the mirror is controlled at a constant speed.

1 Claim, 12 Drawing Sheets

OPTICAL SCANNING APPARATUS AND IMAGE FORMING APPARATUS INCLUDING OPTICAL SCANNING APPARATUS

BACKGROUND OF THE INVENTION

1. Field of the Invention

The present invention relates to an optical scanning apparatus for forming an electrostatic latent image on a photosensitive member by a light beam scanned by a rotational polygon mirror, and an image forming apparatus including the optical scanning apparatus.

2. Description of the Related Art

An electrophotographic image forming apparatus forms an image based on the following process. A light beam output from a light source, such as a semiconductor laser, based on input image data is deflected by a deflect and scan apparatus, such as a rotational polygon mirror (hereinafter, "polygon mirror") and a galvanometer mirror, and is converted into scanning light. A photosensitive member having a uniformly charged surface is scanned by the light beam to form an electrostatic latent image on the photosensitive member.

The electrostatic latent image is developed by a toner, and the developed toner image is transferred onto a sheet of recording paper. Then, the toner image on the recording paper is heat-fixed to form an image on the recording paper.

The polygon mirror and light source are included in the optical scanning apparatus, which is attached to the image forming apparatus. FIG. 9 illustrates an example of a configuration of an optical scanning apparatus. During image formation, a polygon mirror 901 is rotationally driven at a predetermined rotation speed (rotation number) by a drive motor 902.

From a light source 903, a light beam is output based on an image signal modulated based on image data. This light beam is incident onto a reflection surface of the polygon mirror 901. The light beam incident on the reflection surface of the polygon mirror 901 is reflected by the reflection surface of the rotating polygon mirror 901, thereby becoming scanning light. This scanning light passes through an image-forming optical system 904, and is focused on a photosensitive member 906.

As illustrated in FIG. 9, the optical scanning apparatus includes a beam detector (BD) 905 which receives the light beam scanned by the polygon mirror 901. The BD 905 is a sensor provided to synchronize the image writing start position for each scan.

A central processing unit (CPU) (not illustrated) controls the output of the light beam from the light source 903 at a timing based on a synchronization signal (also referred herein as a "BD signal") generated by the light beam incident on the BD 905. Further, the CPU controls the drive motor 902 so that the cycle of this synchronization signal is a constant cycle.

Further, the CPU causes the light source 903 to emit light for each scan. These light beams are detected by a detection unit such as a photodiode. Based on the detection result, the CPU controls the drive current applied to the light source so that the light quantity of the light beams output from the light source when forming the electrostatic latent image becomes a predetermined light quantity (auto power control, hereinafter "APC"). By performing APC, fluctuation in the image density due to fluctuation in the light beam light quantity is suppressed.

Conventionally, in an image forming apparatus having a two-sided printing function for forming an image on both sides of a sheet of recording paper, there has been the problem that the size of the image on the front and back has been different. When forming an image on one side of the recording paper (hereinafter, "front side"), the recording paper passes through a fixing device. By passing the recording paper through the fixing device, moisture absorbed in the recording paper evaporates.

Since the moisture content thus decreases, the size of the recording paper shrinks. Consequently, the size of the image formed on the front side of the recording paper also shrinks. When forming an image on the back side of the thus-shrunk recording paper, unless the size of the image to be formed on the back side is also shrunk, the size of the image to be formed on the back side will be larger than the size of the image formed on the front side. As a result, images having a different size on the front and the back of the recording paper are formed.

To resolve this problem, Japanese Patent Application Laid-Open No. 2007-236031 proposes a technique in which, when performing two-sided printing, the sizes of the image on the front and back are matched by adjusting the image magnification of one side during image formation.

For example, to make the size of the image to be formed on the back side smaller than the size of the image on the front side, when forming the image on the back side, the cycle of the image clock is made shorter and the rotation speed of the polygon mirror is made quicker by a predetermined ratio than a predetermined rotation speed with respect to the front side, than when forming the image on the front side. By controlling in such a manner, the size of the image formed on the back side can be shrunk more than the size of the image formed on the front side.

Further, when a recording medium which has not passed through the fixing device immediately after the images are formed on the front and back of a predetermined recording medium is conveyed, the rotation speed of the polygon mirror needs to be returned to a predetermined rotation speed.

Further, as discussed in Japanese Patent Application Laid-Open No. 05-208522, while continuously forming images on a plurality of recording media when changing the resolution midway through forming the images, it is necessary to control the rotation speed to a desired speed by accelerating or decelerating the rotation speed of the polygon mirror.

However, in some cases the synchronization signal which should be generated during each scan, when the rotation speed of the polygon mirror is changed, is not generated. An example will now be described with reference to FIG. 10B in which the drive motor 902 is accelerated in a situation in which synchronization signals are not being generated in an image forming apparatus capable of forming a plurality of scanning lines during each scan by using a plurality of light emitting elements as the light source.

More specifically, FIG. 10B illustrates a laser control state and a timing for generating a synchronization signal for each scan of an optical scanning apparatus having eight light emitting elements (light emitting elements A to H) outputting a light beam.

Point (1) in FIG. 10B indicates the light emission timing of each light emitting element. Point (2) in FIG. 10B indicates the timing when a BD signal is generated by causing the light emitting element A to emit light when the rotation speed of the polygon mirror 901 is set at a steady speed (100%).

Point (3) in FIG. 10B indicates the timing when a BD signal is generated by causing the light emitting element A to emit light when the rotation speed of the polygon mirror 901 is set at 1% acceleration (101% speed).

As indicated by point (1) in FIG. 10B, during the image region scanning period, a light beam is output from each light emitting element based on the image clock and input image data. The expression "during the image region scanning period" refers to the period during which laser light output from the light source based on the input image data scans the photosensitive member.

During the non-image region scanning period after the image region scanning period, the CPU temporarily turns off all of the light emitting elements, and then sequentially causes the light emitting elements B to H to emit light. Based on a detection result of the light beam output from each of the light emitting elements, APC is performed for the light emitting elements B to H.

Further, the CPU causes a light beam to be output from the light emitting element A. The CPU supplies a drive current to the light emitting element A so that a light beam is output at a timing before the light beam output from the light emitting element A passes the BD 905. The CPU performs APC for the light emitting element A based on a detection result from a photosensor.

Subsequently, the laser light beam output from the light emitting element A due to the CPU keeping the light emitting element A turned on is incident on the BD 905. Consequently, the BD signal is generated.

Then, the CPU causes a light beam to be output from each light emitting element, based on the generated timing of the BD signal during a subsequent period of scanning an image forming region, and based on the image data. To each of the light emitting elements at this stage, a drive current set due to performing APC is supplied. Consequently, a light beam having a predetermined light quantity is output from each light emitting element.

When accelerating the rotation speed of the polygon mirror from the steady speed 100% to a rotation speed of 101%, as illustrated in FIG. 10A, a rotation speed overshoot occurs, and the rotation speed temporarily reaches a speed of more than 101%. At this stage, as indicated by point (4) in FIG. 10B, to generate the BD signal, the light emitting element A has to be turned on at a timing before that of the timing at which the light emitting element A indicated by points (2) and (3) in FIG. 10B is turned on.

However, since there are periods for performing APC for other light emitting elements, the turn-on timing of the light emitting element A cannot be brought forward. In such a case, since the light beam output from the light emitting element A won't be incident onto the BD, the BD signal is not generated. If the BD signal is not generated, the CPU will determine that the cycle of the BD signal has become longer.

Consequently, the CPU controls the drive motor 902 to increase the rotation speed of the polygon mirror 901 in order to shorten the cycle of the BD signal. Despite the fact that the polygon mirror 901 is rotating nearly at the target rotation speed, a large acceleration control is applied. Consequently, it takes time to converge the rotation speed of the polygon mirror 901 to the target rotation speed.

Further, if the rotation speed of the polygon mirror is decelerated, in some cases the synchronization signal cannot be generated unless the light emitting element A is turned on during the unlit period immediately after the turn-on period of the light emitting element A indicated by point (1) in FIG. 10B due to undershooting of the rotation speed.

Thus, when the rotation speed of the polygon mirror is changed, in some cases the synchronization signal cannot be generated due to overshooting or undershooting of the rotation speed.

SUMMARY OF THE INVENTION

According to an aspect of the present invention, an optical scanning apparatus, includes a light source configured to output a light beam based on image data for forming an electrostatic latent image on a photosensitive member, a rotational polygon mirror configured to deflect the light beam so that the light beam moves on a surface of the photosensitive member, a light source control unit configured to control the light source so that the light source outputs the light beam in a first period before a second period in which the light beam deflected by the rotational polygon mirror forms the electrostatic latent image, a detection unit configured to detect the light beam deflected by the rotational polygon mirror during the first period, and a rotation control unit configured to control a rotation speed of the rotational polygon mirror based on a detection cycle of the light beam detected by the detection unit, wherein the light source control unit is configured to control the light source so that a period for outputting the light beam from the light source included in the first period in a state in which the rotation control unit is accelerating or decelerating the rotation speed of the rotational polygon mirror is longer than a period for outputting the light beam from the light source included in the first period in a state in which the rotation speed of the rotational polygon mirror is controlled at a constant speed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
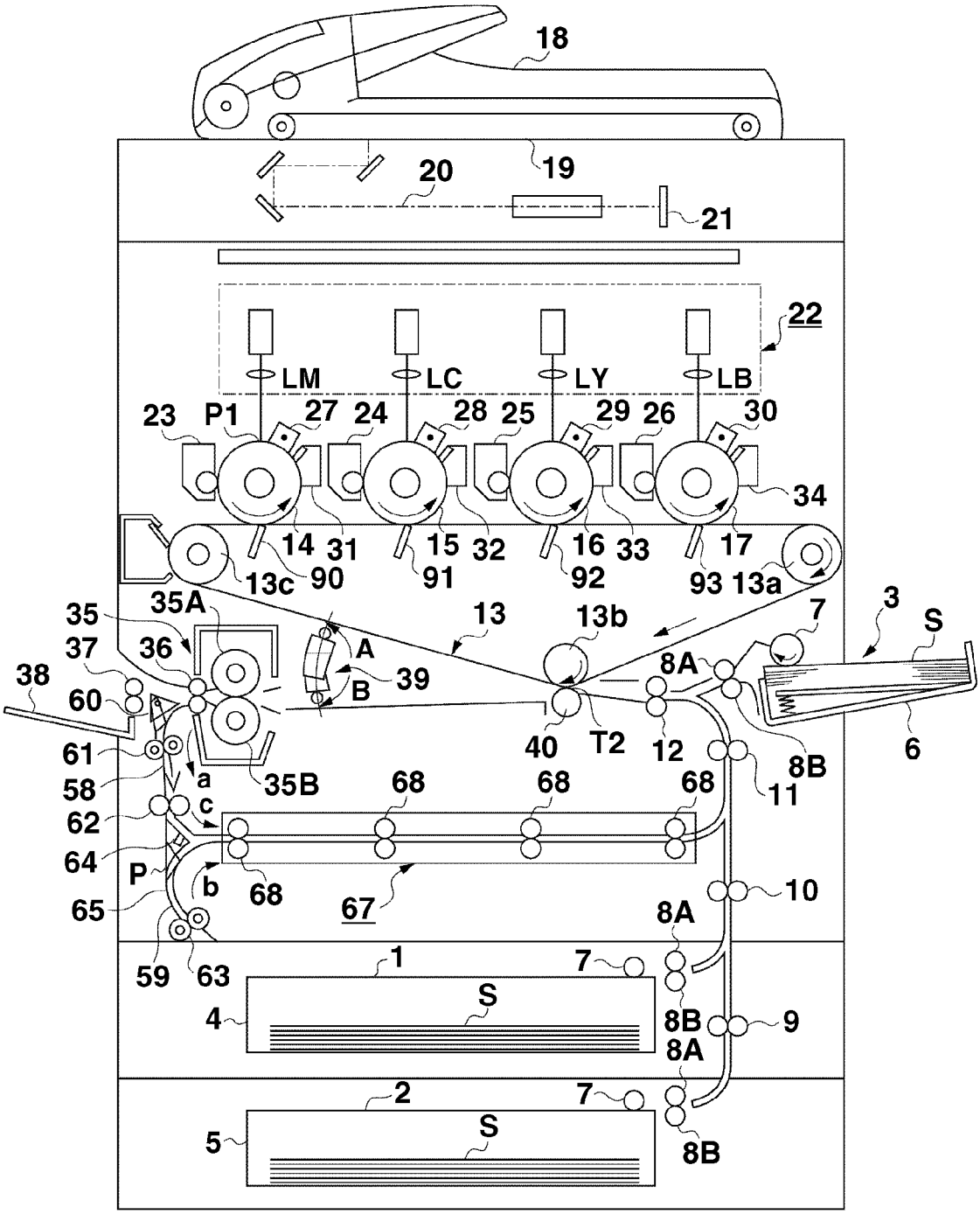
FIGS. 1A and 1B respectively illustrate an image forming apparatus and an optical scanning apparatus according to a first exemplary embodiment.
Figure 1B:
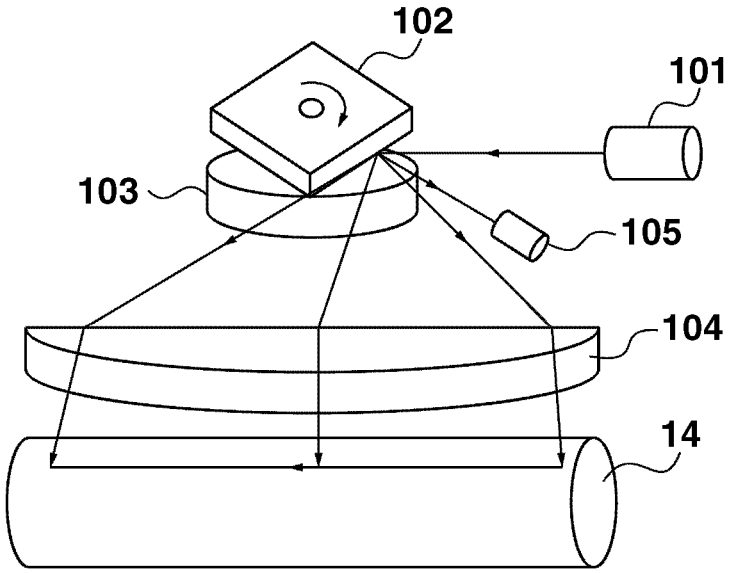

An image forming apparatus and an optical scanning apparatus included in the image forming apparatus according to a first exemplary embodiment will be described referring to FIG. 1, which includes FIG. 1A and FIG. 1B. FIG. 1A is a schematic cross-sectional diagram of a color image forming apparatus. Although the present exemplary embodiment will be described using the color image forming apparatus illustrated in FIG. 1A, the present exemplary embodiment is not limited to a color image forming apparatus. The present exemplary embodiment may also be applied in a monochrome image forming apparatus.

The color image forming apparatus in FIG. 1A has two cassette paper feed units 1 and 2, and one manual paper feed unit 3. Sheets of recording paper S are selectively fed as a recording medium from the respective paper feed units 1 to 3. The sheets of recording paper S are loaded on a cassette 4 or 5 or on a tray 6 of the respective paper feed units 1 to 3. The loaded recording paper S is fed out in order from the topmost sheet by a pickup roller 7.

The top transfer sheet of the recording paper S fed out by the pickup roller is separated by a pair of separation rollers 8 and conveyed to a pair of registration rollers 12 which are not rotating. The pair of separation rollers 8 is configured from a feed roller 8A as a conveying unit and a retard roller 8B as a separation unit.

In this case, the recording paper S fed from the cassettes 4 and 5, which are relatively far from the pair of registration rollers 12, is fed to the pair of registration rollers 12 via a plurality of pairs of conveyance rollers 9, 10, and 11.

When the leading edge of the transfer sheet of the recording paper S fed to the pair of registration rollers 12 abuts a nip of the pair of registration rollers 12 and forms a predetermined loop, conveyance is temporarily stopped. The formation of this loop allows a skewed state of the recording paper S to be corrected.

Downstream of the pair of registration rollers 12, an elongated intermediate transfer belt (endless belt) 13, which is an intermediate transfer member, is stretched around a drive roller 13*a*, a secondary transfer counter roller 13*b*, and a tension roller 13*c*, and is set so as to be in a substantially triangular shape when viewed from a cross section. This intermediate transfer belt 13 rotates in a clockwise direction in FIG. 1.

A plurality of photosensitive drums 14, 15, 16, and 17 (photosensitive members) which form and bear different color toner images are sequentially arranged on a horizontal section upper surface of the intermediate transfer belt 13 along the rotation direction of the intermediate transfer belt 13.

The photosensitive drum 14, which is on the most upstream side in the intermediate transfer belt rotation direction, bears a magenta toner image, the next photosensitive drum 15 bears a cyan toner image, the next photosensitive drum 16 bears a yellow toner image, and the photosensitive drum 17, which is on the most downstream side, bears a black toner image.

Next, the image forming process executed by the above-described image forming apparatus will be described. First, the surface of the photosensitive drum 14 is uniformly charged by a charging device 27. Similarly, the photosensitive drum 15 is charged by a charging device 28, the photosensitive drum 16 is charged by a charging device 29, and the photosensitive drum 17 is charged by a charging device 30.

Exposure with laser light LM on the photosensitive drum 14, which is on the most upstream side, is started based on the image data having a magenta component, whereby an electrostatic latent image is formed on the photosensitive drum 14. This electrostatic latent image is developed by magenta toner supplied from a developing unit 23.

Next, after a predetermined duration has elapsed from the start of laser light LM exposure on the photosensitive drum 14, exposure with laser light LC on the photosensitive drum 15 is started based on the image data having a cyan component, whereby an electrostatic latent image is formed on the photosensitive drum 15. This electrostatic latent image is developed by cyan toner supplied from a developing unit 24.

Further, after a predetermined duration has elapsed from the start of laser light LC exposure on the photosensitive drum 15, exposure with laser light LY on the photosensitive drum 16 is started based on the image data having a yellow component, whereby an electrostatic latent image is formed on the photosensitive drum 16. This electrostatic latent image is developed by yellow toner supplied from a developing unit 25.

After a predetermined duration has elapsed from the start of laser light LY exposure on the photosensitive drum 16, exposure with laser light LB on the photosensitive drum 17 is started based on the image data having a black component, whereby an electrostatic latent image is formed on the photosensitive drum 17. This electrostatic latent image is developed by black toner supplied from a developing unit 26.

The respective magenta, cyan, yellow, and black toner images formed on each of the photosensitive drums sequentially pass through a transfer section between transfer devices 90 to 93 and the respective photosensitive drums while the intermediate transfer belt 13 rotates clockwise, so that the respective toner images are transferred onto the intermediate transfer belt 13.

The toner images transferred onto the intermediate transfer belt 13 are transferred onto a sheet of recording paper S conveyed by a second transfer device 40 at a secondary transfer section T2. Toner remaining on the photosensitive drums that was not transferred onto the intermediate transfer belt 13 is recovered by cleaning devices 31, 32, 33, and 34.

The sheet of recording paper S which has passed the secondary transfer section T2 is fed to a fixing device 35 by the intermediate transfer belt 13. Then, while the recording paper S is passing a nip portion formed by a fixing roller 35A and a pressing roller 35B in the fixing device 35, the recording paper S is heated by the fixing roller 35A and pressed by the pressing roller 35B, so that the transferred toner images are fixed to the sheet surface. Then, the recording paper S, which has passed through the fixing device 35 and undergone the fixing treatment, is sent to a pair of discharge rollers 37 by a pair of conveyance rollers 36, and is discharged onto a discharge tray 38 external to the apparatus.

The image forming apparatus according to the present exemplary embodiment can form an image on both sides of the recording paper S. The configuration of the present image forming apparatus will now be described in more detail based on the flow of the recording paper S during a two-sided mode in which an image is formed on both sides of the sheet.

When a two-sided mode is set by a user, a sheet of recording paper S that has passed through the fixing device 35 and undergone the fixing treatment, passes through a vertical path 58 and then a reversing path 59. In this case, a flapper 60 opens the vertical path 58, and the recording paper S which has undergone the fixing treatment is conveyed by conveyance roller pairs 36, 61, and 62 and a pair of inversing rollers 63.

When the trailing edge of the recording paper S that has undergone the fixing treatment and which is being conveyed in the direction of arrow "a" by the pair of inversing rollers 63 passes a point P, the pair of inversing rollers 63 are inverted, so that the recording paper S that has undergone the fixing treatment is conveyed in the direction of arrow "b" with its trailing edge side in front. Based on this operation, the toner image transferred surface, which has undergone the fixing treatment, of the recording paper S faces upwards in a paper re-feeding path 67.

Further, at the point P, a flexible recording paper flapper 64, which allows the recording paper S to enter the reversing path 59 from the vertical path 58, and prevents the recording paper S from entering the vertical path 58 from the reversing path 59, and a detection lever 65 for detecting passage of the trailing edge of the recording paper past the point P, are provided.

The recording paper S, which has undergone the fixing treatment and which was conveyed in the direction of arrow "b" due to the inversion of the pair of inversing rollers 63, is fed into the paper re-feeding path 67, is passed via the conveyance roller pair 68 and conveyance roller pair 11 in the paper re-feeding path, and is sent to the pair of registration rollers 12 in order to again form an image.

The skewed state of the recording paper S that has undergone the fixing treatment is corrected by the pair of registration rollers 12, and then the recording paper S is conveyed to the intermediate transfer belt 13. Then, based on image data which has accumulated in an image memory (not-illustrated), image formation is performed for the second time. Subsequently, the recording paper S undergoes the same image formation processes as for one-sided image formation, and is externally discharged.

Next, the optical scanning apparatus generating the laser light LM, LC, LY, and LB will be described referring to FIG. 1B. FIG. 1B schematically illustrates one of the optical scanning apparatuses from among four optical scanning apparatuses included in the image forming apparatus.

The laser light (light beam) output from a laser light source 101, such as a semiconductor laser, is incident on to a polygon mirror 102. The laser light source 101 has a plurality of light emitting elements. The laser light source 101 in the present exemplary embodiment has a plurality of light emitting elements A to H (not illustrated).

The polygon mirror 102 (rotational polygon mirror) is rotationally driven by a drive motor 103. The laser light output from the light emitting elements A to H is incident onto the same reflection surface of the rotating polygon mirror 102, is deflected by that reflection surface, and becomes scanning light. This scanning light passes through an image-forming optical system 104, and is guided onto the photosensitive drum 14. The scanning light moves on the photosensitive drum 14.

A BD 105 is a sensor provided to match (synchronize) the latent writing position by the laser light output from each light source on the photosensitive drum during each scan. A synchronization signal (hereinafter, "BD signal") is generated by the laser light output from a predetermined light emitting element hitting the BD 105.

Laser light is output from each of the light emitting elements at a predetermined timing set for each light emitting element based on the BD signal being generated. By thus employing the BD signal, the image writing position on the photosensitive drum of each light emitting element can be made to match.

Further, the drive motor 103 is controlled by a below-described motor control unit so that the BD signal detected by the BD 105 has a predetermined cycle.

Figure 2:
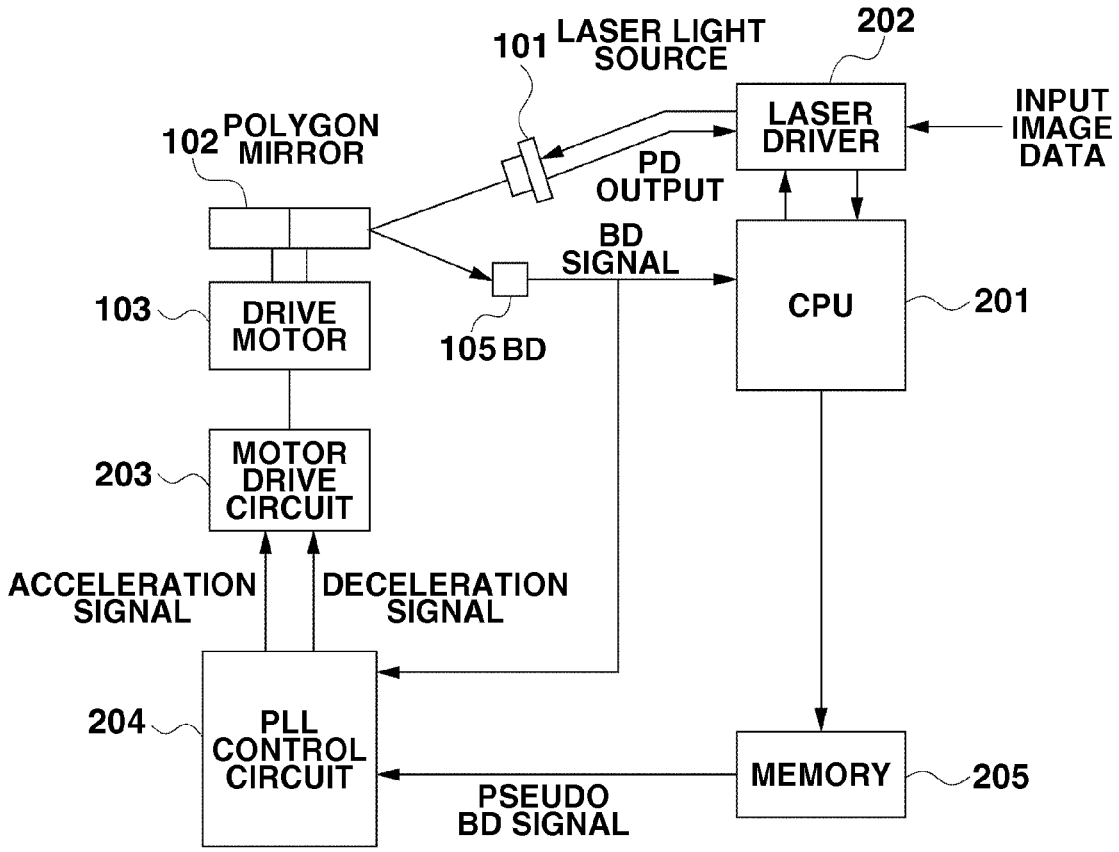
FIG. 2 is a block diagram illustrating an image forming apparatus and an optical scanning apparatus according to the first exemplary embodiment.

FIG. 2 is a control block diagram of an image forming apparatus according to the present exemplary embodiment. The image forming apparatus according to the present exemplary embodiment includes a CPU 201, a laser driver 202, which is a light source control unit, the drive motor 103, a motor drive circuit 203, which is a motor control unit, a PLL (phase-locked loop) control circuit 204, the laser light source 101, and a memory 205.

Using FIG. 2, automatic power control (hereinafter, "APC") and control of the rotation speed of the polygon mirror 102 will now be described.

First, APC will be described. The CPU 201 starts counting-up of a not-illustrated internal clock based on the BD signal input from the BD 105. Then, the CPU 201 determines whether the laser light is scanning an image region or a non-image region on the photosensitive drum based on the count value of a reference clock.

The term "image region" means a scanning region which is scanned by laser light to form input image data, a toner pattern for density adjustment, and a registration pattern for color shift correction. The term "non-image region" means a region other than the above-described "image region" among the regions scanned by the laser light. The APC is performed during the period that the laser light is scanning the non-image regions.

When performing APC, laser light is output from each of the light emitting elements A to H of the laser light source 101 at a predetermined timing after the BD signal is detected toward the polygon mirror 102 at a respectively different timing. At this stage, laser light (referred to as "rear laser light") is also output in the opposite direction to the direction that the laser light progresses from the light emitting elements A to H toward the polygon mirror 102.

A photodiode (hereinafter, "PD") for receiving the rear laser light is included in the laser light source 101. A detection signal from the PD is input into the laser driver 202. The reason for performing APC in the non-image regions is that the front laser light corresponding to the rear laser light does not irradiate the photosensitive drum when performing APC.

The detection signal input to the laser driver 202 is sent to the CPU 201. The CPU 201 reads a reference voltage corresponding to a target light quantity from the memory 205, and calculates the difference between the voltage of the detection signal input to the laser driver 202 and the reference voltage. Based on the calculated difference, the CPU 201 controls the current supplied to each of the light emitting elements of the laser light source 101.

For example, if the voltage of the detection signal output from the PD which detected the light beam output from a predetermined light emitting element is lower than the reference voltage, the light quantity (intensity) of the laser light output from that light emitting element is lower than the target light quantity. Consequently, the CPU 201 controls the laser driver 202 so as to increase the current value which causes laser light to be output from that light emitting element.

On the other hand, if the voltage of the detection signal output from the PD which has detected the light beam output from a predetermined light emitting element is higher than the reference voltage, the light quantity of the laser light output from that light emitting element is higher than the target light quantity. Consequently, the CPU 201 controls the laser driver 202 so as to decrease the current value which causes laser light to be output from that light emitting element. This APC is individually performed for each of the light emitting elements A to H.

Next, control of the rotation speed of the polygon mirror 102 will be described. Laser light output from the light emitting element A is incident on the BD 105 arranged on the scanning line. In response to the received laser light, the BD 105 generates a BD signal. The generated BD signal is input to a PLL control circuit 204.

Further, based on an instruction from the CPU 201, a pseudo BD signal is input from the memory 205 to the PLL control circuit 204. This pseudo BD signal is a signal in which pulses are generated at a cycle corresponding to the target rotation speed of the polygon mirror 102. If there is a plurality of target rotation speeds, a pseudo BD signal corresponding to each target rotation speed exist.

The PLL control circuit 204 controls the rotation speed of the polygon mirror 102 so that the cycle of the BD signal matches the cycle of the pseudo BD signal by comparing the cycle of the BD signal and the cycle of the pseudo BD signal. More specifically, if the cycle of each of the signals input to the PLL control circuit 204 satisfies (BD signal cycle)< (pseudo BD signal cycle), the PLL control circuit 204 sends an instruction to reduce the rotation speed of the polygon mirror 102 to the motor drive circuit 203 (deceleration control).

On the other hand, if the cycle of each of the signals input to the PLL control circuit 204 is (BD signal cycle)>(pseudo BD signal cycle), the PLL control circuit 204 sends an instruction to increase the rotation speed of the polygon mirror 102 to the motor drive circuit 203 (acceleration control).

Further, in a color image forming apparatus which forms an image with a plurality of polygon mirrors, the rotation phase also needs to be matched among the plurality of polygon mirrors in order to match the image leading edge position in the main scanning direction for each color. Consequently, the PLL control circuit 204 controls the motor drive circuit 203 so that the phase of the BD signals matches the phase of the pseudo BD signals.

Further, a clock signal is input to the CPU 201 from a clock generation unit (not illustrated). The CPU 201 starts the count of the clock signal in response to the generation of the BD signal. The CPU 201 instructs the laser driver 202 to output laser light from the respective light emitting elements A to H based on the count reaching a predetermined count value set so as to correspond to the respective light emitting elements A to H.

In the present exemplary embodiment, first the CPU 201 sends an instruction to the laser driver 202 to individually turn on the light sources B to H during the period that the laser light scans a non-image region, and then performs APC for the light sources B to H.

At this stage, the CPU 201 causes each light source to emit light at a respectively different timing based on the BD signal generated during the previous non-image region scanning period. Then, the CPU 201 sends an instruction to the laser driver 202 to turn on the light source A, and performs APC for the light source A.

Since the laser light from the light source A needs to be reliably incident on the BD 105, the turn-on period of the light source A is longer than the turn-on period of the light sources B to H. The BD 105 generates the BD signal in response to the laser light incident from the light source A. To prevent unevenness in the density of the output image from being produced, APC is performed for each scan during the non-image region scanning period.

Further, the reason for performing APC prior to the laser light being incident on the BD 105 is that the BD 105 is arranged as close as possible to the image region. Arranging the BD 105 as close as possible to the image region enables the BD signal to be generated at a timing closer to the timing at which the laser light reaches the image region.

With this configuration, unevenness in the image writing position can be suppressed even when the rotation speed of the polygon mirror slightly fluctuates during the APC period.

When forming the image in two-sided mode, the toner image is transferred onto one of the sides (front side), and a sheet of the recording paper S is passed through the fixing device 35 to fix that toner image. When the recording paper S is passing through the fixing device 35, moisture contained in the recording paper S evaporates. Consequently, the size of the recording paper S shrinks (e.g., by 1%).

If the magnification of the toner image transferred onto the surface of the recording paper S is 100%, since the size of the recording paper S shrinks by 1%, the magnification of the toner image after passing through the fixing device 35 changes to 99%. When the 100% toner image is formed in this state on the other side (back side), since the recording paper S has already passed through the fixing device 35 once, the recording paper S does not shrink as much as when the image was formed on the front side.

Consequently, the magnification of the toner image on the front side is 99%, and the magnification of the toner image on the back side is 100%, so that the size of the images on the front and back are different.

Therefore, anticipating this shrinkage of the recording paper S, the CPU 201 performs a correction to decrease the image magnification in the main/sub-scanning directions when forming the image on the back side. The magnification correction in the main scanning direction is performed by increasing the writing speed of the image memory by 1%.

With this correction, the size of the toner image in the main scanning direction can be shrunk by 1%. On the other hand, the magnification correction in the sub-scanning direction is performed by increasing the rotation speed of the drive motor 103 by 1%. Based on this correction, the size of the toner image in the sub-scanning direction can be shrunk by 1%.

However, if the rotation speed of the polygon mirror is accelerated in order to perform the magnification correction in the sub-scanning direction, this can prevent the BD signal from being generated if the rotation speed of the polygon mirror overshoots. To prevent this problem, the image forming apparatus according to the present exemplary embodiment can generate the BD signal even if the rotation speed of the polygon mirror overshoots during acceleration.

Figure 3A:
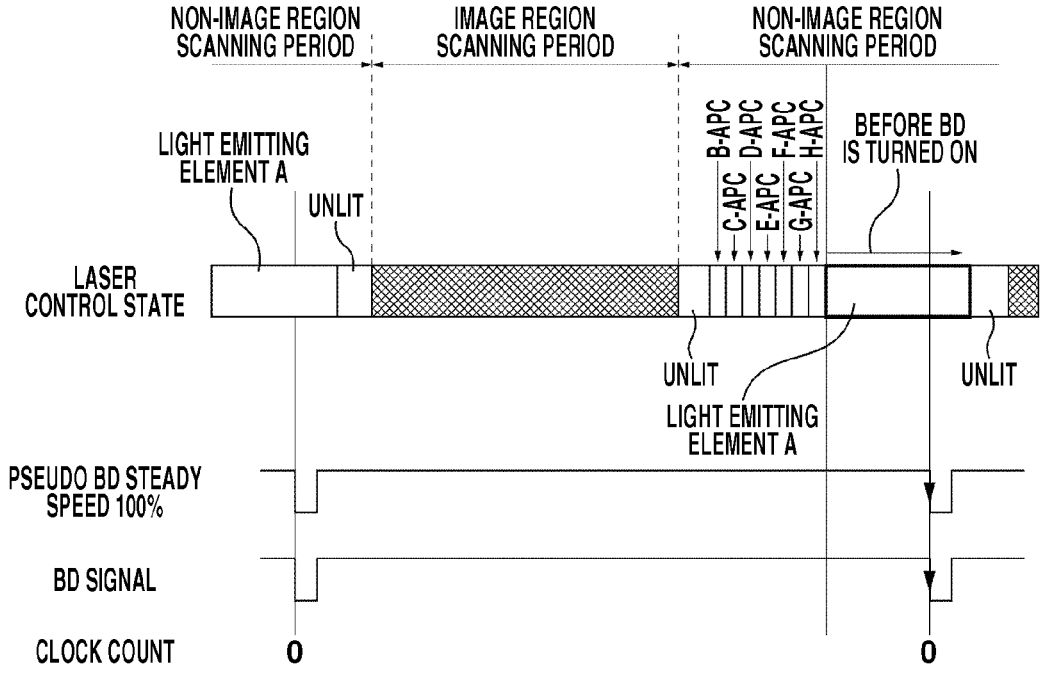
FIGS. 3A and 3B are timing charts illustrating the timing for causing each light source to emit light in order to perform APC for light sources A to H and to generate a BD signal.
Figure 3B:
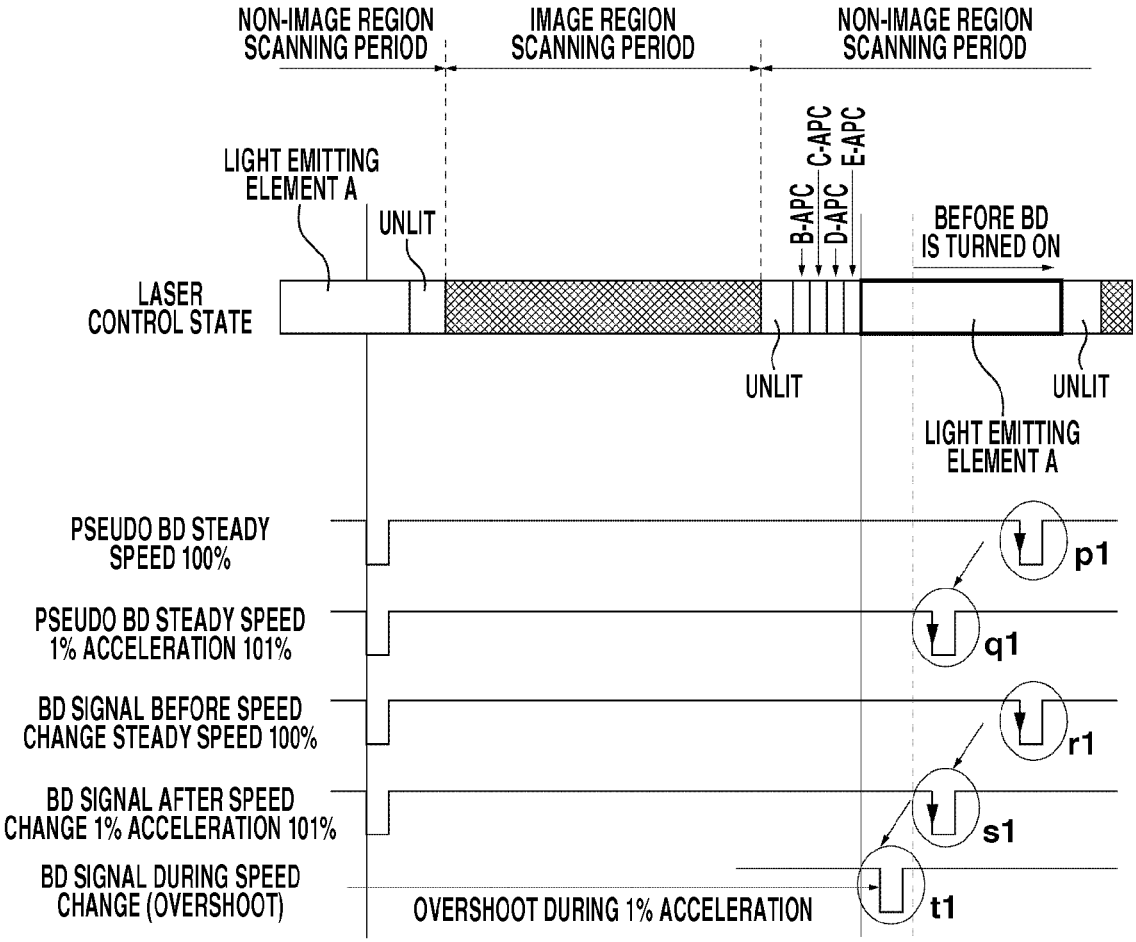

FIGS. 3A and 3B are timing charts illustrating a timing for causing each of the light emitting elements to emit light and the generation timing of a BD signal in order to perform APC for each of the light sources A to H, and to generate the BD signal. FIG. 3A is a timing chart for when the polygon mirror 102 is rotated at constant speed (100% speed). FIG. 3B is a timing chart illustrating the timing for causing the light emitting elements to emit light and the generation timing of the BD signal in a state in which the rotation speed of the polygon mirror 102 is accelerated to 101%.

As illustrated in FIG. 3A, during a non-image region scanning period (first period), first, all of the light emitting elements are temporarily turned off, and then the light emitting elements B to H are sequentially turned on and APC is performed. Next, the light emitting element A is turned on, APC for light emitting element A is performed, and the BD signal is generated.

Subsequently, all of the light emitting elements are temporarily turned off, and then during the image region scanning period (second period), laser light is output from each light emitting element at a timing based on a predetermined light quantity and the generated BD signal.

In response to the generation of the BD signal, the CPU 201 resets the count value of the clock signal. APC and the writing of the image during the image region scanning period are performed based on this count value.

As illustrated in FIG. 3B, for the image forming apparatus according to the present exemplary embodiment, the CPU 201 performs APC for light emitting elements B to E during the non-image region scanning period (first period) while the polygon mirror 102 is under acceleration control, and controls the light emitting elements F to H during the first period so that APC is not performed. Subsequently, the CPU 201 brings forward the turn-on start of the light emitting element A during the first period, performs APC for the light emitting element A, and keeps the light emitting element A on to generate the BD signal.

During the next non-image region scanning period, the CPU 201 performs APC for at least light emitting elements F to H, and does not perform APC for light emitting elements B to E. Alternatively, the combination of the light emitting elements for which APC is performed for each scan may be changed so that APC is performed, for example, for B, C, D, and E during the first scan non-image region scanning period (first period), F, G, H, and B during the second scan, and C, D, E, and F during the third scan.

Thus, APC for each of the light emitting elements is performed at least once while that the laser light is scanned twice.

Figure 4:
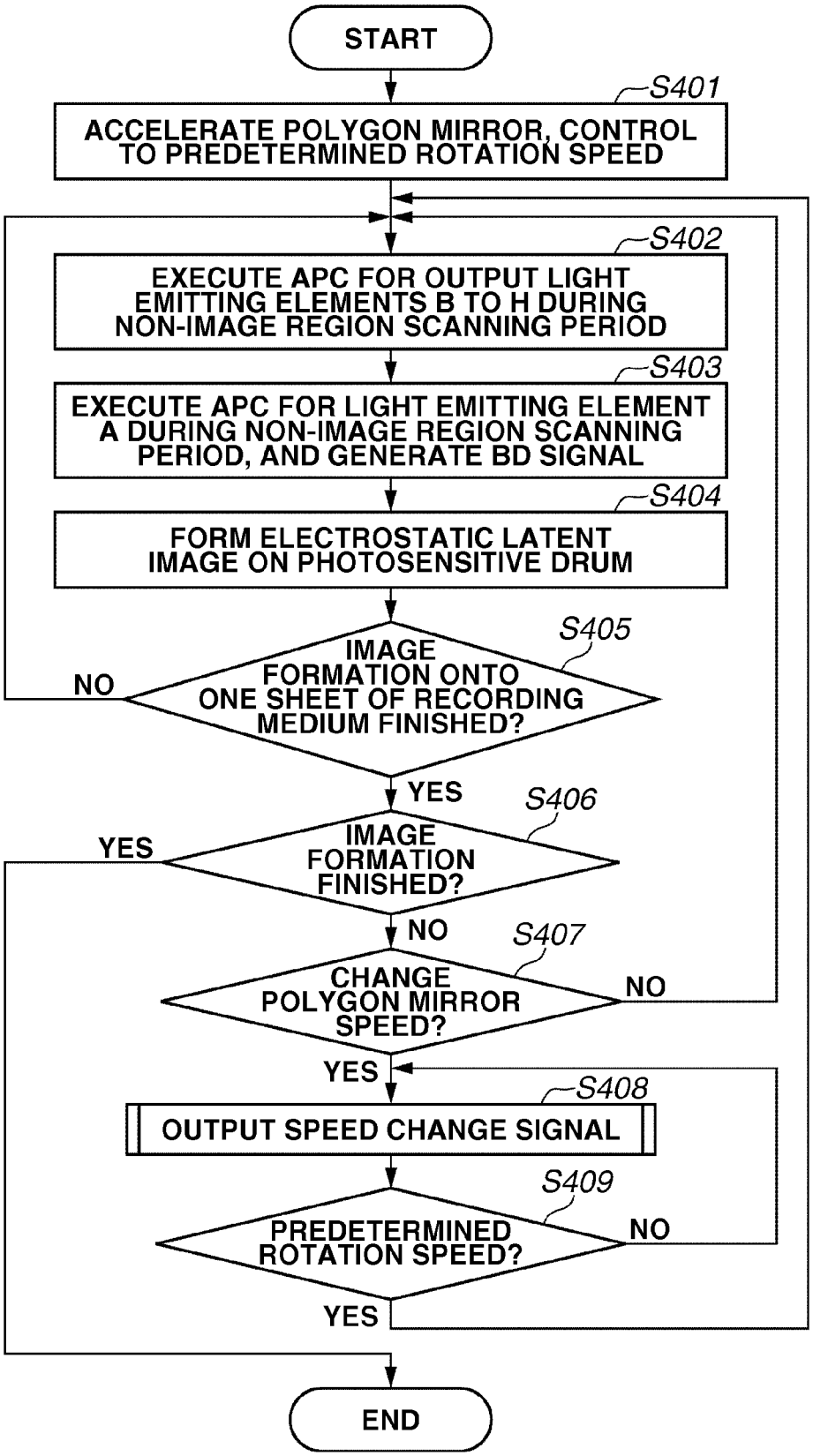
FIG. 4 illustrates a control flow executed by a CPU for APC and to generate a BD signal.

FIG. 4 is a flowchart illustrating a control flow executed by the CPU 201 for APC and to generate a BD signal in an image forming apparatus in which the rotation speed of the polygon mirror 102 is changed. The control flow is started at step S401, when the polygon mirror rotates at a predetermined rotation speed (first rotation speed).

In step S402, when the polygon mirror 102 is rotating at a constant speed, as illustrated in FIG. 3A, the CPU 201 performs APC for each of the plurality of light emitting elements B to H during the non-image region scanning period. More specifically, the CPU 201 sequentially turns on the light emitting elements B to H, and outputs a control signal to the laser driver 202 based on the received light quantity of the PD which received the rear laser light output from each of the light emitting elements. The laser driver 202 controls the drive current supplied to the light emitting elements based on the control signal.

Next, in step S403, the CPU 201 performs APC for the light emitting element A. At this stage, so that the laser light output from the light emitting element A is reliably incident on the BD, the CPU 201 turns on the light emitting element A for a longer duration than the light emitting elements B to H are turned on during the non-image region scanning period. The CPU 201 sets the current supplied to the light emitting element A based on a detection result of the rear laser light output from the light emitting element A.

In step S403, the BD signal generated according to the front laser light corresponding to the rear laser light is output from the BD 105. In step S404, when APC for each light emitting element is finished, the CPU 201 outputs during the image region scanning period the laser light from each light emitting element based on the image data after a predetermined timing from the BD signal being output to form an electrostatic latent image on the photosensitive drum. At this stage, the drive current set by performing APC is supplied for each light emitting element.

Next, in step S405, the CPU 201 determines whether image formation onto one sheet of recording medium has finished. If it is determined in step S405 that image formation onto one sheet of recording medium has not finished (NO in step S405), the processing returns to step S401.

On the other hand, if it is determined in step S405 that image formation onto one sheet of recording medium has finished (YES in step S405), in step S406, the CPU 201 determines whether image formation based on the input image data has finished.

If it is determined in step S406 that image formation based on all of the input image data has finished (YES in step S406), the CPU 201 ends the present control. On the other hand, if it is determined in step S406 that image formation based on the input image data has not finished (NO in step S406), in step S407, the CPU 201 determines whether it is necessary to change the speed of the polygon mirror.

When consecutively forming an image on a large number of sheets, immediately after an image to be transferred is formed on a sheet that has not passed through a fixing device, there may be a case in which an image to be transferred on the back side of a sheet of which front side an image has been fixed, may be formed. Alternatively, immediately after the image to be transferred on the back side of a sheet is formed, onto whose front side an image has been fixed, there may be a case in which an image to be transferred on a sheet which has not passed through the fixing device is formed.

In such cases, as described above, the rotation speed of the polygon mirror needs to be changed. Therefore, in step S407, the CPU 201 determines whether it is necessary to change the rotation speed (accelerate or decelerate) of the polygon mirror 102.

If it is determined that it is not necessary to change the rotation speed of the polygon mirror 102 (NO in step S407), the processing of the control flow returns to step S401. On the other hand, if it is determined that it is necessary to change the rotation speed of the polygon mirror 102 (YES in step S407), in step S408, in order to control the rotation speed of the polygon mirror 102, the CPU 201 sends an instruction to the PLL control circuit to output an acceleration signal or a deceleration signal to the motor drive circuit.

In step S409, the CPU 201 determines whether the rotation speed has reached a predetermined speed. If it is determined that the rotation speed has reached the predetermined speed (YES in step S409), the processing returns to step S402. On the other hand, if it is determined in step S409 that the rotation speed has not reached the predetermined speed (NO in step S409), the processing returns to step S408.

When forming an image to be transferred on the back side of a sheet onto of which front side an image has been fixed immediately after the image to be transferred is formed on a sheet that has not passed through a fixing device, it is necessary to accelerate the rotation speed of the polygon mirror 102. During this process, a rotation speed overshoot occurs, in which the rotation speed of the polygon mirror 102 temporarily increases beyond a target rotation speed.

Figure 10A:
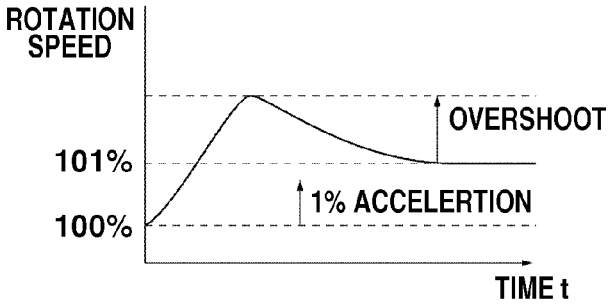
FIGS. 10A and 10B are respectively a diagram illustrating an example of an overshoot amount during acceleration of a rotation speed of a polygon mirror, and a timing chart according to a conventional example illustrating the timing for causing each light source to emit light in order to perform APC for light sources A to H and to generate a BD signal.
Figure 10B:
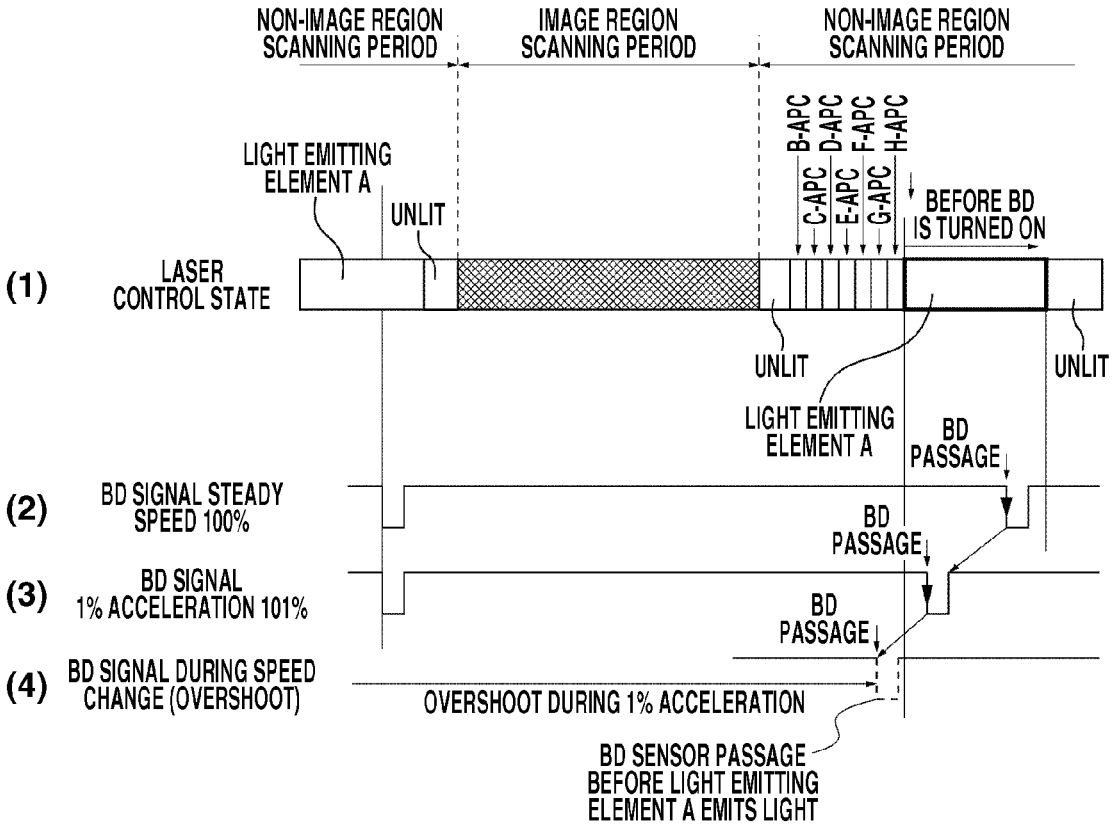

If an overshoot occurs, as illustrated in FIG. 10B, the scanning position of a laser A may have passed the BD when the laser A is made to emit light. In such a case, since the BD signal cannot be generated, the rotation speed of the drive motor 103 may be controlled based on an erroneous BD signal cycle.

Therefore, for the image forming apparatus according to the present exemplary embodiment, the turn-on period of a predetermined light emitting element (in the present exemplary embodiment, light emitting element A) is extended in order to generate the BD signal during a non-image region scanning period so that the BD signal is reliably generated even when performing acceleration control on the polygon mirror 102.

To provide time so that the turn-on time (laser light output period) of this predetermined light source can be increased, a light emitting element for which APC is not performed during the non-image region scanning period, specifically, a light emitting element which does not output the laser light for performing APC, is provided for the light emitting elements other than the predetermined light emitting element.

When accelerating the polygon mirror 102, the control may be performed so that only the predetermined light emitting element for generating the BD signal is turned on during the non-image region scanning period. In this case, the CPU 201 outputs laser light from the predetermined light emitting element so that the turn-on time is roughly the same as the non-image region scanning period. With such a control, the phenomenon in which the BD signal is not generated can be prevented.

However, if APC of the light emitting elements B to H is not performed while the rotation speed of the polygon mirror 102 is being accelerated, a time for performing the APC of the light emitting elements A to H has to be provided after the acceleration control has finished. When performing APC after a period in which APC has not been continuously performed, performing APC once is insufficient to stabilize the light quantity of the laser light. Therefore, formation of the electrostatic latent image must be started after APC is performed a plurality of times and the light quantity is stabilized.

When consecutively performing image formation on several hundred or several thousand sheets of recording paper S, the time required to perform APC a plurality of times is accumulated up, making the image output time excessive. Therefore, it is desirable to continuously perform APC for each light emitting element as much as possible even during the period of accelerating the polygon mirror 102.

Figure 5:
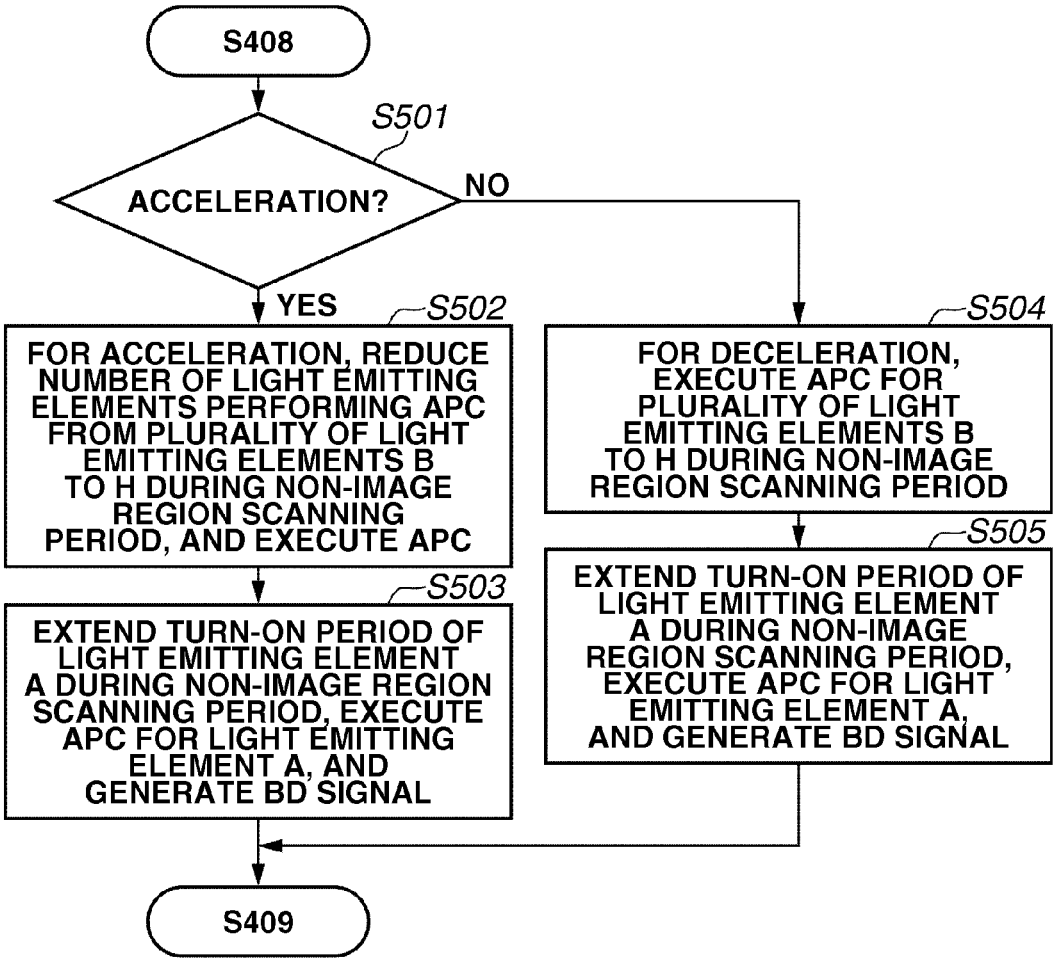
FIG. 5 is a flowchart illustrating a control flow according to the first exemplary embodiment executed by a CPU.

The control flow executed by the CPU 201 during acceleration control of the polygon mirror rotation speed in step S408 of FIG. 4 will now be described referring to FIG. 5. If it is determined in step S407 of FIG. 4 that it is necessary to change the rotation speed of the polygon mirror (YES in step S407), in step S408 the control flow proceeds to step S501. In step S501, the CPU 201 determines whether the speed change control is an acceleration control or a deceleration control.

In step S501, if it is determined that the speed change control is an acceleration control (accelerating from a first rotation speed to a second rotation speed) (YES in step S501), in step S502, the number of light emitting elements for which APC is performed is reduced from among the light emitting elements B to H, and APC is performed for the light emitting elements for which APC can be performed. More specifically, APC is not performed for all of the light emitting elements B to H. The light emitting elements for which APC is performed are limited. Further, APC may be performed for neither of the light emitting elements B to H.

Next, in step S503, a duration within the non-image region scanning period produced due to the number of light emitting elements for which APC is performed being reduced is allocated to the turn-on time of the light emitting element A. More specifically, the turn-on time of the light emitting element A is extended by bringing forward the timing for turning on the light emitting element A into the non-image region scanning period.

Subsequently, the processing returns to step S409. On the other hand, if it is determined in step S501 that the speed change control is a deceleration control (NO in step S501), in step S504, APC is performed for light emitting elements B to H during the non-image region scanning period.

Then, in step S505, the period for turning on the light emitting element A during the non-image region scanning period is extended, APC is performed for the light emitting element A, and the BD signal is generated. If decreasing the rotation speed of the polygon mirror from 100% speed to 99% speed, if a rotation speed undershoot occurs, the rotation speed of the polygon mirror decreases to 99% or less.

If the rotation speed of the polygon mirror is decelerated, the non-image region scanning duration increases. Therefore, time for performing APC for the light emitting elements B to H can be obtained. More specifically, when the rotation speed of the polygon mirror is decelerated, unlike when the rotation speed is accelerated, APC is performed for all of the light emitting elements, without limiting the number of light emitting elements for which APC is performed.

However, if the rotation speed undershoots, it may be impossible to generate the BD signal unless the light emitting element A is turned on during the unlit period immediately after the turn-on timing of the light emitting element A in FIG. 3. To prevent this, if performing deceleration control, as described above, the turn-on period of the light emitting element A is extended at the back end. More specifically, at least a part of the unlit period in FIG. 3 is used as an extension turn-on period of the light emitting element A.

The above control is performed during the period in which the drive motor 103 is under acceleration control and deceleration control. More specifically, the control illustrated in FIG. 5 is executed during the period until acceleration of the polygon mirror rotation speed from 100% to 101% is completed, and the period until deceleration from 100% to 99% is completed.

By performing the above-described APC sequence control, light emission can be started before the beam which generates the BD signal passes the BD even if the rotation speed of the polygon mirror 102 overshoots or undershoots. Therefore, the BD signal can be reliably generated. Further, even when performing acceleration control, light source APC can be continuously performed.

The number of light emitting elements for which APC is not performed may be determined based on the acceleration amount of the drive motor 103. For example, when accelerating the polygon mirror, to perform image formation as quickly as possible, the acceleration time needs to be shortened. Therefore, a larger acceleration is set for when accelerating from a speed of 100% to 102% than when accelerating from 100% to 101%.

In this case, the amount of overshoot is larger for when accelerating from a speed of 100% to 102% than when accelerating from 100% to 101%. Therefore, for example, APC may be performed in the non-image region for four light emitting elements when accelerating from a speed of 100% to 101%, and APC may be performed in the non-image region for five light emitting elements when accelerating from a speed of 100% to 102%. Consequently, the BD signal can be reliably generated even when the acceleration is large.

Figure 6:
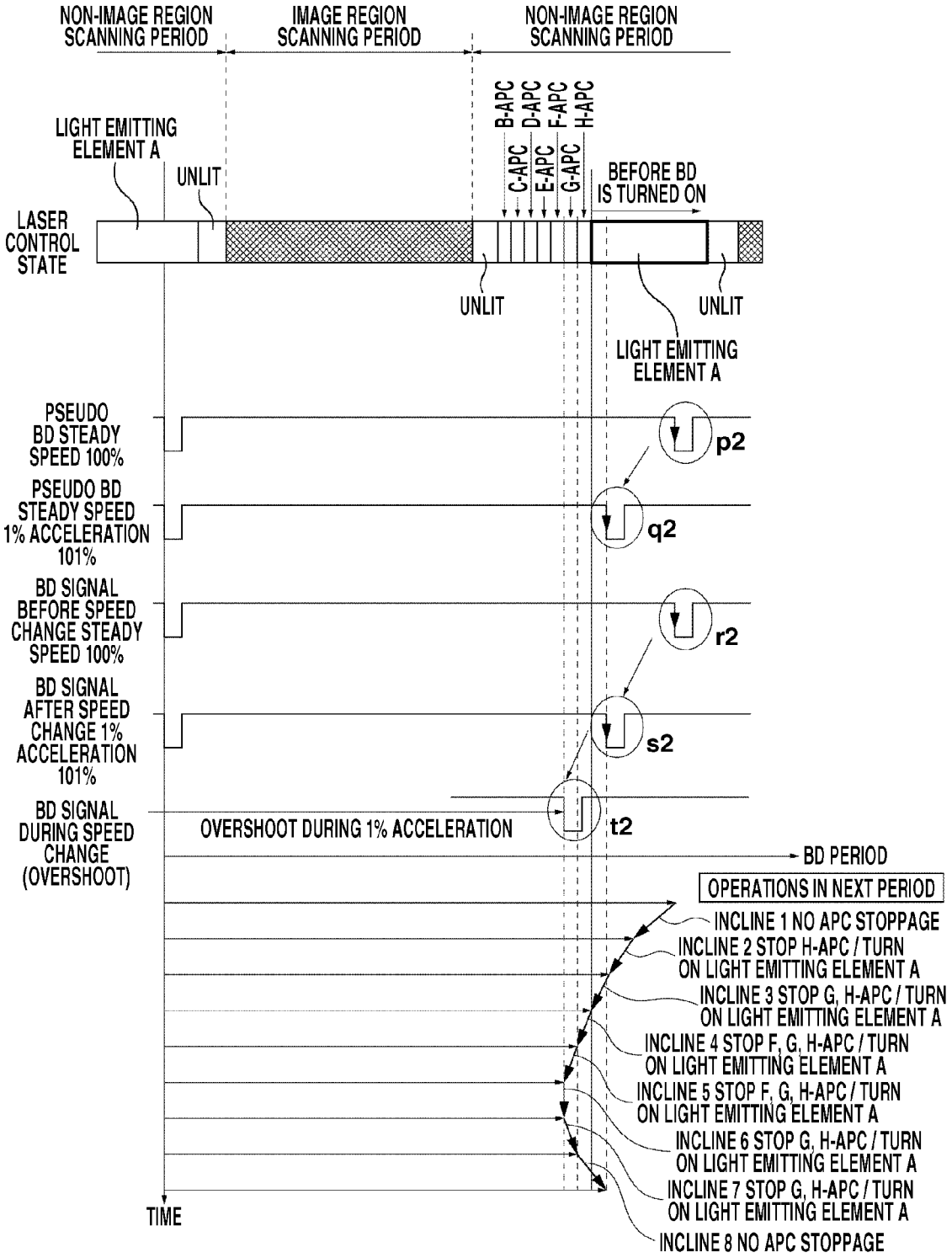
FIG. 6 is a timing chart illustrating the timing according to a second exemplary embodiment for causing each light source to emit light in order to perform APC for light source A to H and to generate a BD signal.

A second exemplary embodiment will now be described. As illustrated in FIG. 6, the timing when the laser light scans the BD while the rotation speed of the polygon mirror is being accelerated can be predicted at the design stage. Therefore, the image forming apparatus according to the present exemplary embodiment determines the number of light emitting elements for which APC is not performed based on prediction data of the timing when the laser light scans the BD during acceleration control of the rotation speed of the polygon mirror.

By providing a light emitting element for which APC is not performed, a duration occurring during the non-image region period is used for the turn-on period of the light emitting element A which outputs laser light for generating the BD signal. More specifically, unlike the first exemplary embodiment, the number of light emitting elements for which APC is not performed is switched based on the cycle that the laser light scans the BD during the non-image region scanning period.

The cycle that the laser light scans the BD during acceleration control of the rotation speed of the polygon mirror can be determined by experimentation during the design stage. For example, as illustrated in FIG. 6, during the non-image region scanning period in the timing chart, a BD signal virtually generated based on the detection of the laser light output from the light emitting element A during acceleration control of the polygon mirror shows a trend like that illustrated in FIG. 6.

Based on this data, the timing for outputting laser light from the light emitting element A during acceleration control, which enables the BD signal to be generated, can be predicted. This data is stored in the memory 205. Based on this data, the number of light emitting elements, for which APC is performed during acceleration control, is determined.

Alternatively, the number of light emitting elements for which APC is performed may be determined based on a prediction result obtained by predicting the timing that the laser light output next from the light emitting element A will scan the BD based on the cycle data of the BD signal detected during acceleration control.

In the present exemplary embodiment, an example is described in which the number of light emitting elements for which APC is not performed is determined based on a prediction result obtained by the CPU 201 monitoring the cycle of the BD signal, and predicting the timing that the laser light output next from the light emitting element A will scan the BD from the cycle of the BD signal based on the rate of change of that BD signal cycle.

Figure 7:
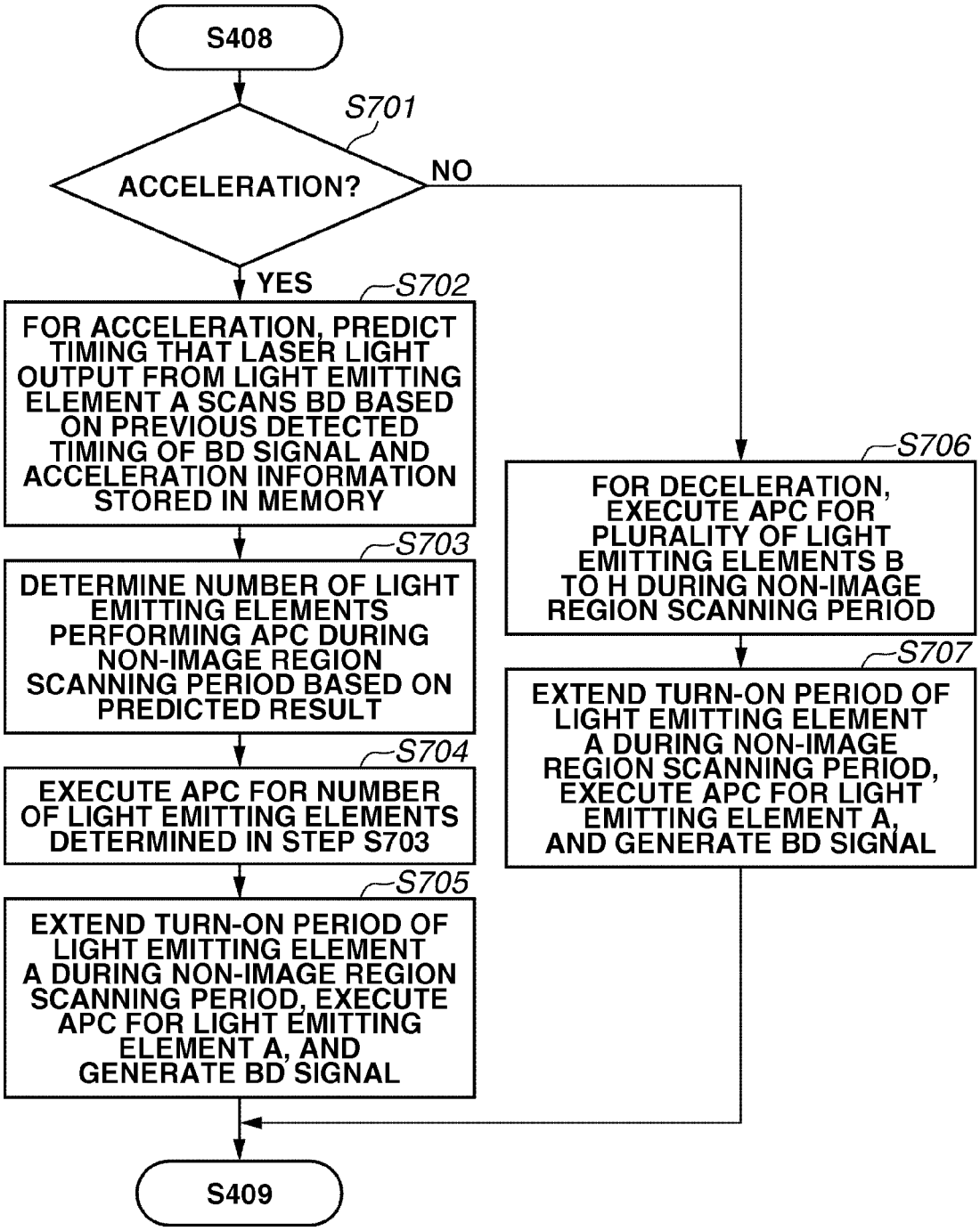
FIG. 7 is a flowchart illustrating a control flow according to a second exemplary embodiment executed by a CPU.

FIG. 7 illustrates a control flow executed by the CPU 201. The CPU 201 forms an image by performing the control of FIG. 4 illustrated in the first exemplary embodiment. The control flow illustrated in FIG. 7 is a control flow executed in step S408 of FIG. 4.

If it is determined in step S407 of FIG. 4 that it is necessary to change the rotation speed of the polygon mirror (YES in step S407), in step S408 the processing proceeds to step S701. In step S701, the CPU 201 determines whether that speed change control is an acceleration control or a deceleration control.

In step S701, if it is determined that the speed change control is an acceleration control (acceleration from a first rotation speed to a second rotation speed) (YES in step S701), in step S702, the CPU 201 predicts the timing that the laser light output from the light emitting element A will scan the BD based on the detected timing of the previous BD signal during the non-image region scanning period and the above-described data stored in the memory 205.

This detection timing can be detected by a counter which starts a count based on the BD signal being generated.

Next, in step S703, the CPU 201 determines the number of light emitting elements for which APC is performed from among the plurality of light emitting elements B to H based on the predicted results. In step S704, laser light is output from the light emitting elements for which it has been determined in step S703 that APC would be performed, and APC is performed. Next, in step S705, the light emitting element A is turned on in the non-image region scanning period produced by providing a light emitting element for which APC is not performed, APC is performed for the light emitting element A, and the BD signal is generated. Then, the processing proceeds to step S409 in FIG. 4.

In step S701, if it is determined that the speed change control is a deceleration control (NO in step S701), in step S706, APC is performed for light emitting elements B to H during the non-image region scanning period. Subsequently, in step S707, the period for turning on the light emitting element A during the non-image region scanning period is extended, APC is performed for the light emitting element A, and the BD signal is generated.

By performing the above-described APC sequence control, light emission can be started before the beam which generates the BD signal passes the BD sensor even if the rotation speed of the polygon mirror overshoots during acceleration. Therefore, control of the drive motor 103 can be continued based on a correct BD signal. Further, since the number of light emitting elements for which APC is not performed can be reduced based on the overshoot amount, APC can be performed for as many light sources as possible during the non-image region scanning period.

In addition, the number of light emitting elements for which APC is performed during the non-image region scanning period may also be determined based on the acceleration amount of the rotation speed of the polygon mirror. For example, when accelerating from a first rotation speed to a second rotation speed, and when accelerating from the first rotation speed to a third rotation speed that is faster than the second rotation speed, the latter cases will have a larger acceleration amount per unit time. Therefore, the rotation speed overshoot amount will also be larger.

Accordingly, during the non-image region scanning period, the number of light emitting elements for which APC is performed when accelerating from the first rotation speed to the third rotation speed that is faster than the second rotation speed is less than the number of light emitting elements for which APC is performed when accelerating from the first rotation speed to the second rotation speed. Consequently, APC can be continuously performed, and the BD signal can be reliably generated, even if the acceleration amount increases.

A third exemplary embodiment of the present invention will now be described. In the second exemplary embodiment, other than the light emitting element A, a light source for which APC is not performed is provided, based on a rate of change in the cycle of the BD signal obtained by the CPU 201 monitoring the BD signal cycle. In contrast, in the present exemplary embodiment, APC is performed for the respective light emitting elements, and the duration for outputting the laser light to perform APC for each light emitting element is shortened.

The drive motor and APC control of the two-sided mode printing according to the present exemplary embodiment will be described referring the control flowchart of FIG. 8.

Figure 8:
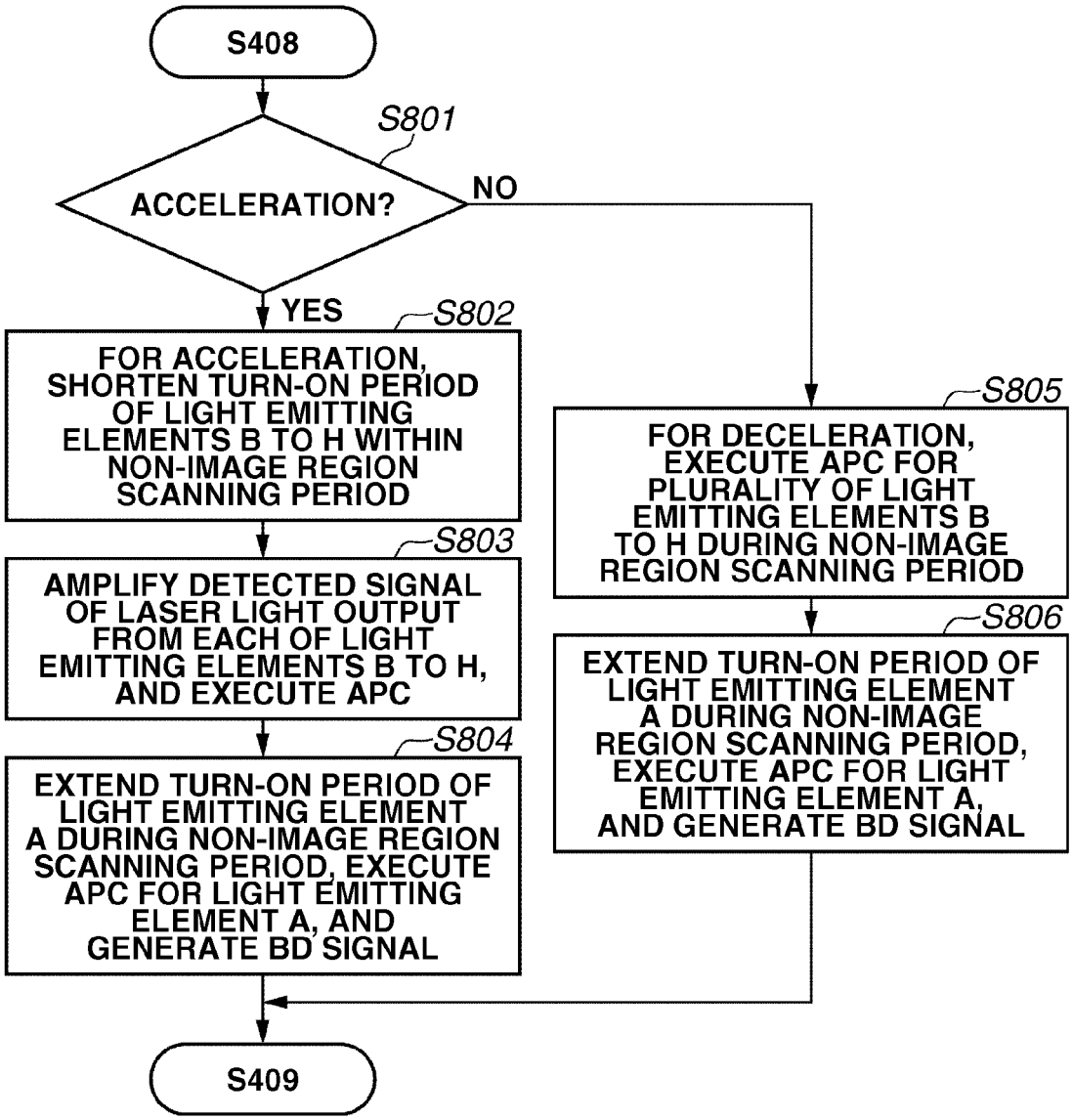
FIG. 8 is a flowchart illustrating a control flow according to a third exemplary embodiment executed by a CPU.
Figure 9:
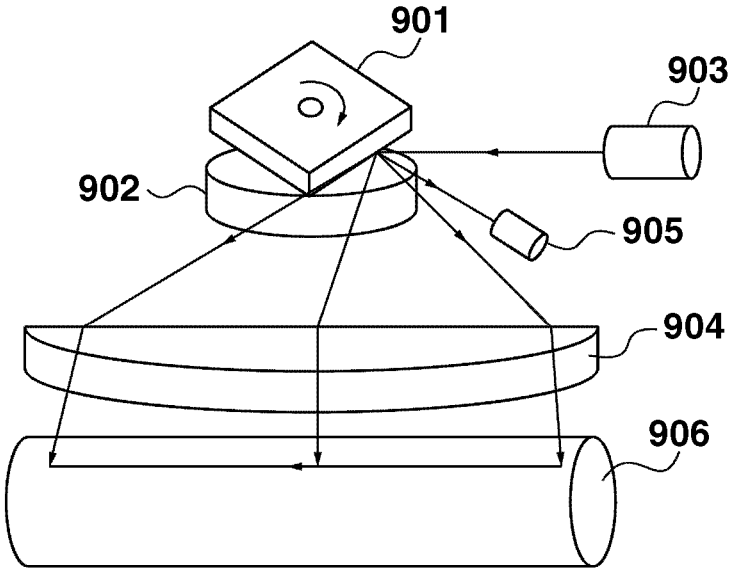
FIG. 9 is a schematic diagram of an optical scanning apparatus.

The CPU 201 forms an image by performing the control of FIG. 4 described in the first exemplary embodiment, and executing the control flow of FIG. 8 in step S408 of FIG. 4.

If it is determined in step S407 of FIG. 4 that it is necessary to change the rotation speed of the polygon mirror (YES in step S407), in step S408 the control flow proceeds to step S801. In step S801, the CPU 201 determines whether that speed change control is an acceleration control or a deceleration control.

In step S801, if it is determined that the speed change control is an acceleration control (acceleration from a first rotation speed to a second rotation speed) (YES in step S801), in step S802, the CPU 201 causes laser light to be output from each of the light emitting elements B to H during the non-image region scanning period at a respectively different timing.

In step S802, the CPU 201 sets the duration for turning on the light emitting elements B to H to be shorter than the duration for turning on the light emitting elements B to H in step S402 of FIG. 4. Since the emission duration of the light emitting element B to H light sources in step S802 is shortened, the light quantity of the rear laser light detected by the PD decreases.

In step S803, to supplement the decreased light quantity due to the shortening of the emission duration, the CPU 201 amplifies the detection signal from the PD, and performs APC based on the amplified detection signal. The duration during the non-image region scanning period obtained by shortening the duration for turning on the light emitting elements B to H is used for the emission duration of the light emitting element A. Next, in step S804, APC is performed for the light emitting element A, and the BD signal is generated. Then, the processing proceeds to step S409 in FIG. 4.

In step S801, if it is determined that the speed change control is a deceleration control (NO in step S801), in step S805, APC is performed for light emitting elements B to H during the non-image region scanning period. Subsequently, in step S806, the period for turning on the light emitting element A during the non-image region scanning period is extended, APC is performed for the light emitting element A, and the BD signal is generated.

By performing the above-described APC sequence control, light emission can be started before the beam which generates the BD signal passes the BD sensor even if the rotation speed of the polygon mirror overshoots during acceleration. Therefore, control of the rotation speed of the polygon mirror can be continued based on a correct BD signal.

Further, since the number of light sources for which APC is not performed can be reduced based on the overshoot amount, APC can be performed for as many light emitting elements as possible during the non-image region scanning period.

Aspects of the present invention can also be realized by a computer of a system or apparatus (or devices such as a CPU or MPU) that reads out and executes a computer-executable program recorded on a non-transitory computer-readable medium (e.g., memory device) to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2009-290100 filed Dec. 22, 2009 and No. 2010-241202 filed Oct. 27, 2010, which are hereby incorporated by reference herein in their entirety.

What is claimed is:

1. An optical scanning apparatus, comprising:

a light source including a plurality of light emitting elements and configured to output a light beam from the plurality of light emitting elements based on image data for forming an electrostatic latent image on a photosensitive member;

a rotational polygon mirror configured to deflect the light beam so that the light beam moves on a surface of the photosensitive member;

a detection unit configured to detect the light beam deflected by the rotational polygon mirror;

a light source control unit configured to cause the plurality of light emitting elements to output the light beam in a first period other than a second period in which the photosensitive member is scanned with the light beam for performing auto power control for the plurality of light emitting elements; and a rotation control unit configured to control a rotation speed of the rotational polygon mirror based on a detection cycle of the light beam detected by the detection unit, the rotation control unit performing acceleration control for accelerating changing the rotation speed of the rotational polygon mirror from a first target speed to a second target speed that is faster than the first target speed or constant speed control for maintaining the rotation speed of the rotational polygon mirror at the first target speed or the second target speed, the plurality of light emitting elements emit the light beams based on the image data in a state in which the constant speed control is performed, wherein a number of the auto power control for the light emitting elements in one scanning cycle of the light beam while the rotation control unit is performing the acceleration control, is smaller than a number of the auto power control for the light emitting elements in one scanning cycle of the light beam while the rotation control unit is performing the constant speed control.

* * * * *